US011110478B2

(12) United States Patent
Wang et al.

(10) Patent No.: US 11,110,478 B2
(45) Date of Patent: Sep. 7, 2021

(54) HIGH-PRESSURE AIRLESS SPRAY NOZZLE ASSEMBLY

(71) Applicant: Wuxi Jinheda Precision Manufacturing Co., Ltd, Wuxi (CN)

(72) Inventors: Zhenyu Wang, Wuxi (CN); Qinghua Li, Wuxi (CN)

(73) Assignee: QUA TECH LIMITED

( * ) Notice: Subject to any disclaimer, the term of this patent is extended or adjusted under 35 U.S.C. 154(b) by 145 days.

(21) Appl. No.: 16/279,653

(22) Filed: Feb. 19, 2019

(65) Prior Publication Data

US 2019/0336992 A1 Nov. 7, 2019

(30) Foreign Application Priority Data

May 4, 2018 (CN) ..... 201810418572.X

(51) Int. Cl.

| | |
|---|---|
| ***B05B 15/534*** | (2018.01) |
| ***B05B 1/02*** | (2006.01) |
| *B05B 7/02* | (2006.01) |
| *B05B 15/16* | (2018.01) |

(52) U.S. Cl.

CPC ..... *B05B 15/534* (2018.02); *B05B 1/02* (2013.01); *B05B 7/02* (2013.01); *B05B 15/16* (2018.02)

(58) Field of Classification Search

CPC ... B05B 15/534; B05B 15/65–68; B05B 1/18; B05B 1/02; B05B 7/02

USPC ..... 239/390–397, 600

See application file for complete search history.

(56) References Cited

U.S. PATENT DOCUMENTS

| | | | | |
|---|---|---|---|---|
| 4,165,836 | A * | 8/1979 | Eull | B05B 9/01 239/119 |
| 4,483,481 | A * | 11/1984 | Calder | B05B 1/00 239/119 |
| 4,508,268 | A * | 4/1985 | Geberth, Jr. | B05B 15/534 239/119 |
| 4,611,758 | A * | 9/1986 | Geberth, Jr. | B05B 15/534 239/119 |
| 4,635,850 | A * | 1/1987 | Leisi | B05B 1/326 239/119 |
| 4,830,281 | A * | 5/1989 | Calder | B05B 1/16 239/119 |
| 5,765,753 | A * | 6/1998 | Kieffer | B05B 15/534 239/119 |

* cited by examiner

*Primary Examiner* — Cody J Leiuwen

(57) ABSTRACT

A saddle seal assembly for a high-pressure airless spray nozzle having a spray tip includes a metal sealing sleeve and a cylindrical elastic seal. The metal sealing sleeve may include a first saddle-shaped semi-cylinder surface closely matching with an outer surface of the spray tip to form an outer hard sealing structure. The cylindrical elastic seal may include a second saddle-shaped semi-cylinder surface closely matching with the outer surface of the spray tip to form an inner flexible sealing structure. A first end portion of the cylindrical elastic seal is configured to be inserted into the metal sealing sleeve, and the first saddle-shaped semi-cylinder surface and the second saddle-shaped semi-cylinder surface are configured to be spliced to form a continuous saddle-shaped semi-cylinder surface, to thereby seal a stepped inlet hole of the high-pressure airless spray nozzle.

20 Claims, 6 Drawing Sheets

HIGH-PRESSURE AIRLESS SPRAY NOZZLE ASSEMBLY

CROSS-REFERENCE TO RELATED APPLICATIONS

This application claims the benefit of Chinese Patent Application 201810418572.X, filed May 4, 2018. The entire disclosures of the applications referenced above are incorporated by reference.

FIELD

The present disclosure generally relates to spaying equipment, and more particularly to high-pressure airless spray nozzle assemblies.

BACKGROUND

A variety of techniques are currently available for high-pressure airless spray nozzle assemblies. Because high-pressure airless sprayers have the characteristics of light weights and stable output pressures, the sprayers have been widely used in home finishing, building and road constructions, dock constructions and other industries. The demand is increasing both at home and abroad. The high-pressure airless sprayers spray various fluid by output atomization through the spray tip. The key components for achieving atomized output are a spray tip and a saddle-shaped seal ring, which are usually sold an accessory assembly.

The spray tip needs to be closely fitted to the saddle-shaped sealing ring and fixed in a spray tip guard, which is coupled with a spray gun frame via nuts to facilitate atomized spraying.

Traditionally, the spray tip and the seal ring are precisely fitted to form a metal-to-metal hard seal, the required dimensions of the saddle-shaped semi-cylinder metal surface have to be very accurate, and the surfaces of the spray tip and the seal ring can only be seamlessly fitted by precision machining. Such process is very costly, inefficient and unreliable, which directly affects effectiveness of the atomization and normal use of the high pressure airless spray tip. Further, the high-pressure airless spray tip needs to be reversed for internal cleanse between uses by turning the spray tip 180 degrees to a clean position. Thus, the spray tip and the saddle-shaped seal undergo certain amount of torque and friction, which causes the fitted surfaces to be scratched, resulting in a matching gap, and causing drips or splashes to occur during use.

Thus, a high pressure airless nozzle with better sealing properties and a longer service life is developed, as disclosed below, significantly improves upon the state-of-the-art, solves the above problems effectively, and enables functions that could not have been successfully performed before.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A high-pressure airless spray nozzle includes a spray tip guard, a spray tip configured to be inserted into the spray tip guard perpendicularly to the axis of the spray tip guard, and a saddle seal assembly configured to be inserted into the spray tip guard along the axis of the spray tip guard. The saddle seal assembly includes a metal sealing sleeve and a cylindrical elastic seal. The metal sealing sleeve includes a first saddle-shaped semi-cylinder surface closely matching with an outer surface of the spray tip to form an outer hard sealing structure. The cylindrical elastic seal includes a second saddle-shaped semi-cylinder surface closely matching with the outer surface of the spray tip to form an inner flexible sealing structure. A first end portion of the cylindrical elastic seal is configured to be inserted into the metal sealing sleeve. The first saddle-shaped semi-cylinder surface and the second saddle-shaped semi-cylinder surface are configured to be spliced to form a continuous saddle-shaped semi-cylinder surface in order to seal a stepped inlet hole of the high-pressure airless spray nozzle.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

The present disclosure describes a high-pressure airless spray nozzle assembly that has the following enhanced outcomes: for example, 1) greatly increases the production efficiency and reduces production costs for saddle seal assembly by combining a soft sealing structure with a hard sealing structure; 2) improves sealing effect and extends the seal's service life; 3) lowers the requirement for manufacturing measurement precision; and 4) allows more convenient operation without a tool.

Various embodiments and examples are disclosed in the present disclosure to illustration the solution.

Figure 1:
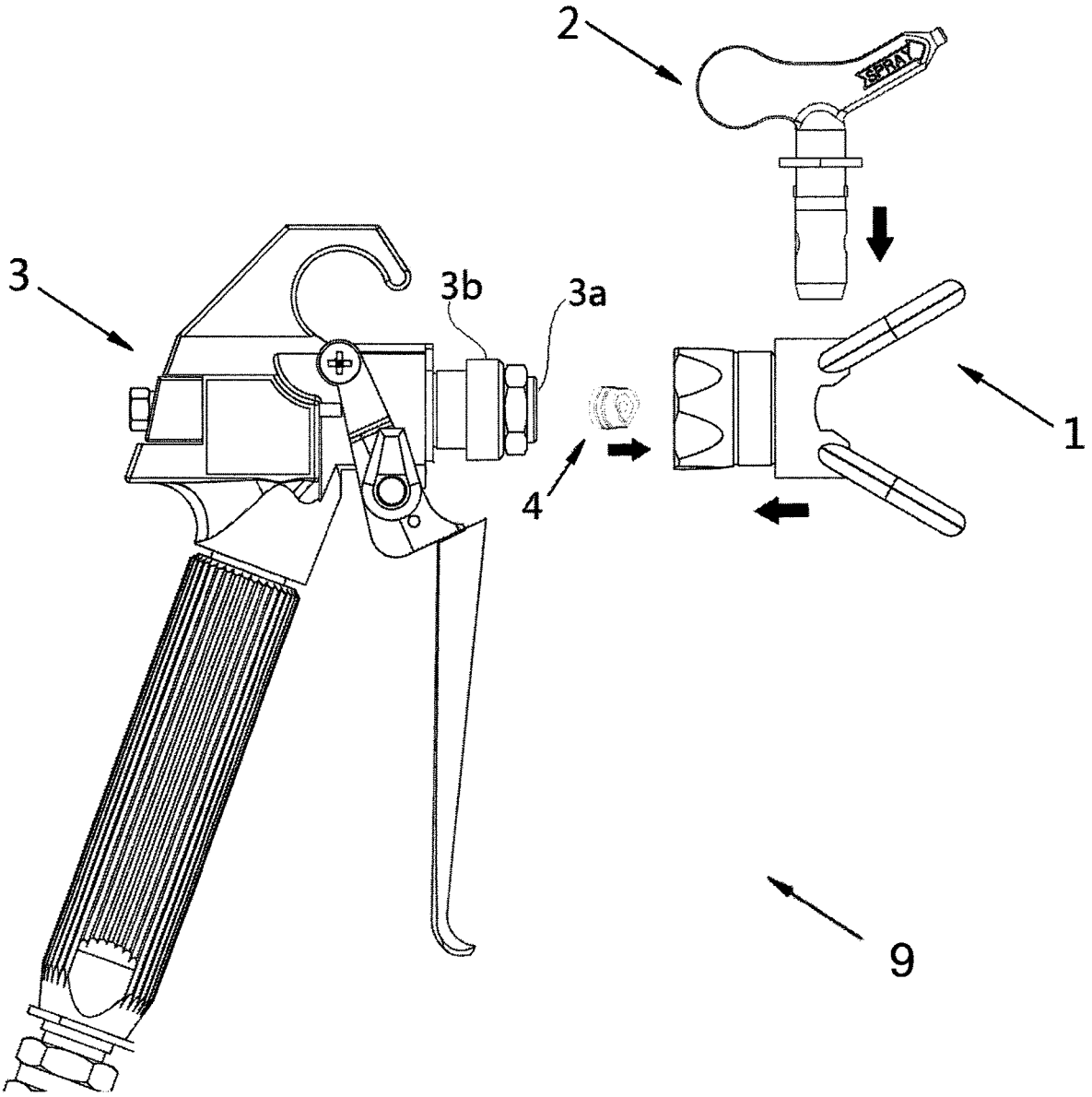
FIG. 1 is an exploded perspective view of an example spaying equipment including a high pressure airless nozzle having a spray tip guard, a spray tip, a spray gun, and a saddle seal assembly according to the principles of the present disclosure.

As shown in FIG. 1, the example spaying equipment 9 including the high pressure airless nozzle 10 having a spray tip guard 1, a spray tip 2, and a saddle seal assembly 4. The high-pressure airless nozzle 10 is used in the spray gun 3. The spray tip 2 is vertically inserted into the spray tip guard 1. The axis of the spray tip 2 is perpendicular to the axis of the spray tip guard 1. The saddle seal assembly 4 is inserted into the spray tip guard 1. The axis of the saddle seal assembly 4 is along the axis of the spray tip guard 1. The saddle seal assembly 4 is formed by a cylindrical elastic seal 6 and a metal sealing sleeve 5 (also shown in FIGS. 5 and 6). The spray gun 3 includes a connection tube 3*b* with a connection end 3*a*. The spray tip guard 1 is screwed onto the spray gun connection tube 3*b* via the connection end 3*a*.

Figure 2:
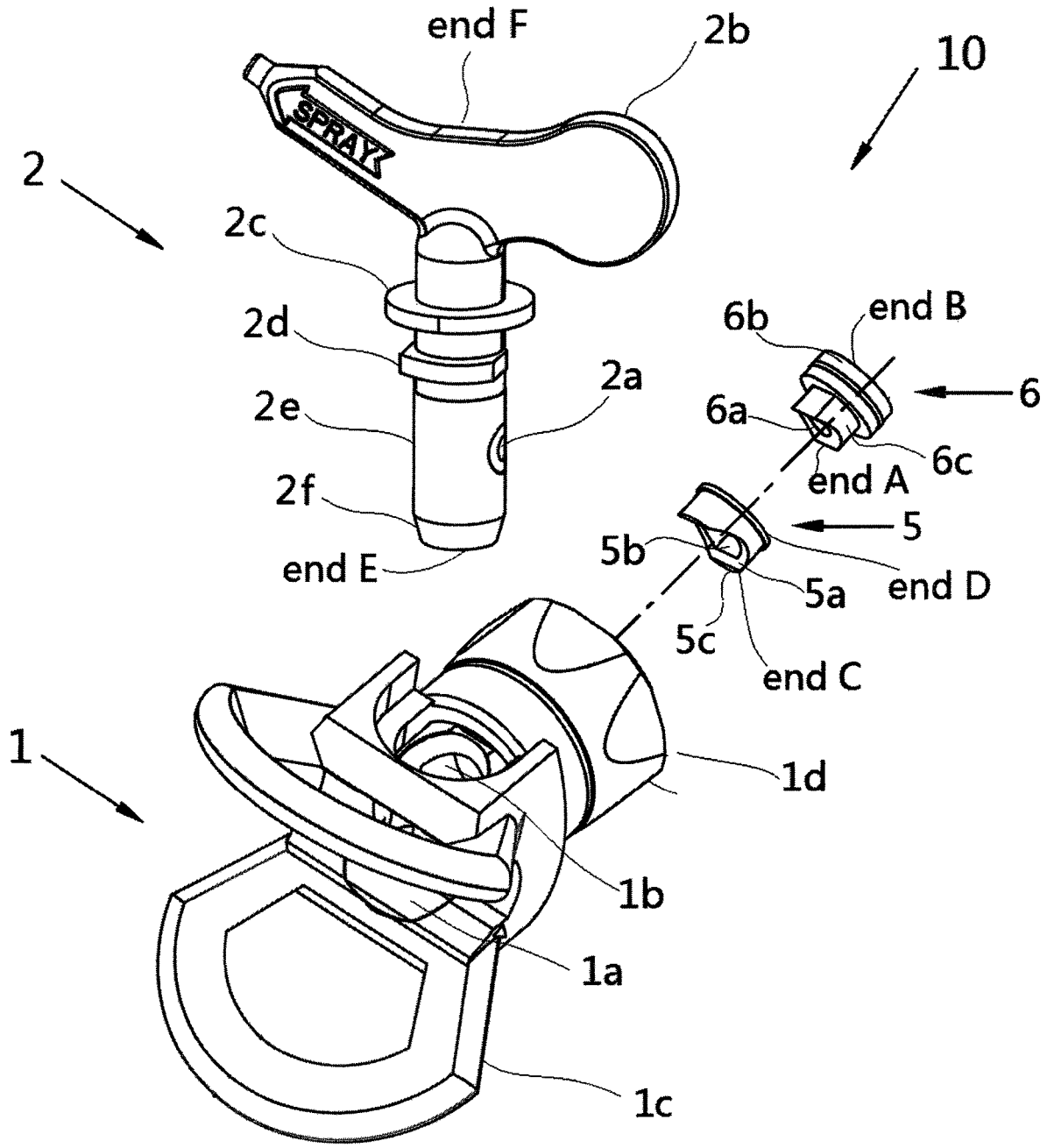
FIG. 2 is another exploded perspective view of the spray tip guard, the spray tip, the saddle seal assembly and the spray tip guard of the example high pressure airless nozzle of FIG. 1.

Specifically, FIGS. 2 and 3 illustrate that the spray tip guard 1 includes a coupling/mounting nut 1*d*, a wear-resistant inner sleeve 8, and one or more diverging tip guard members 1*c*. Each of the one or more diverging tip guard members 1*c* has a U-shaped structure.

The one or more diverging tip guard members 1*c* are configured to support the spray tip 2 and keep the spray tip 2 from touching the ground. The one or more diverging tip guard members can also serve as carrying handles when the spray tip 2 is not in use. The one or more diverging tip guard members 1*c* are configured to be connected to the outside of the wear-resistant inner sleeve 8.

Additionally, a horizontal hole 1*a* is opened/defined in an axial direction of the spray tip guard 1. One end of the horizontal hole 1*a* is an inlet, and the other end is an outlet. A vertical hole 1*b*, which joins with the horizontal hole 1*a*, is opened/defined in a radial direction of the spray tip guard 1.

Figure 4:
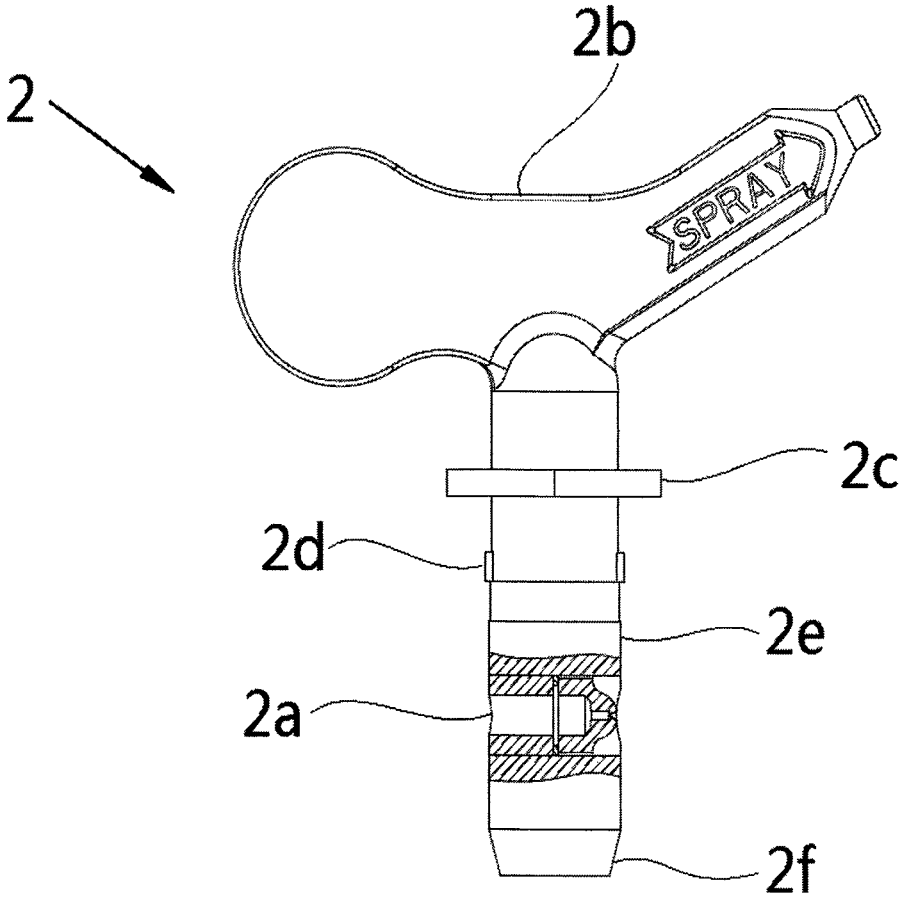
FIG. 4 is a perspective view of the spray tip of FIG. 1, with partial sectional view showing a stepped inlet hold of the spray tip.

As shown in FIG. 4, end E of the spray tip 2 is adapted to be inserted into and tightly fitted to the vertical hole 1*b* and blocks the horizontal hole 1*a*. The spray tip 2 is adapted to be inserted into a connection hole defined within the wear-resistant inner sleeve 8 through the vertical hole 1*b*. A stepped inlet hole 2*a* is opened/defined in the spray tip 2 near end E.

The metal sealing sleeve 5 is disposed inside the horizontal hole 1*a* and located close to the inlet end of the horizontal hole 1*a*. The metal sealing sleeve 5 further includes a saddle-shaped semi-cylinder surface 5*a* on the side close to the spray tip 2 and configured to match/fit with the outer surface of the spray tip 2 with end C of the metal sealing sleeve 5. The high pressure airless nozzle 10 further includes the cylindrical elastic seal 6 configured to be inserted into the metal sealing sleeve 5 with end A of the cylindrical elastic seal 6, extended beyond the saddle-shaped semi-cylinder surface 5*a*, having a saddle-shaped semi-cylinder surface 6*a* match/fit with the outer surface of the spray tip 2. When the saddle-shaped semi-cylinder surface 6*a* seals one end of the stepped inlet hole 2*a*, the saddle-shaped semi-cylinder surface 5*a* and the saddle-shaped semi-cylinder surface 6*a* are spliced (combined) to form a continuous saddle-shaped semi-cylinder surface, which seals the stepped inlet hole 2*a*. In other words, the saddle-shaped semi-circular surface 5*a* serves as a preliminary seal, and the saddle-shaped semi-cylinder surface 6*a* serves as a complemental seal to further prevent leakage.

The high-pressure airless nozzle design according to the present disclosure greatly improves parts production efficiency and reduces the production cost by combining a flexible sealing structure and a hard sealing structure. The saddle-shaped semi-cylinder surface 5*a* closely matching/fitting with the outer surface of the spray tip 2 forms an outer hard sealing structure. The saddle-shaped semi-cylinder surface 6*a* closely matching/fitting with the outer surface of the spray tip 2 forms an inner flexible sealing structure.

Specifically, the connection hole of the wear-resistant inner sleeve 8 is hard sealed with the spray tip 2. When the spray tip guard 1 is screwed onto the connecting tube 3*b* of the spray gun 3 by the mounting nut 1*d*, the connecting end 3*a* of the spray gun 3 pushes back the saddle seal assembly 4 into close contact with the spray tip 2. The preliminary seal provided by the saddle-shaped semi-circular surface 5*a* is a hard seal while the seal between the saddle-shaped semi-cylinder surface 6*a* and the spray tip 2 is a soft seal.

In addition, the outer surface of the metal sealing sleeve 5 is in close contact with the inner surface of the horizontal hole 1*a*. When the wear-resistant inner sleeve 8 is used, the metal sealing sleeve 5 is placed inside the wear-resistant inner sleeve 8 and is hard sealed with the inner surface of the wear-resistant inner sleeve 8.

During the mounting process, the cylindrical elastic seal 6 is pressed by the connecting end face 3*a*. Since the cylindrical elastic seal 6 has a tendency to move toward the spray tip 2, the saddle-shaped semi-cylinder surface 6*a* can maintain a close contact with the outer surface of the spray tip 2 to achieve a good seal.

The spray tip 2 may include a cylinder-shaped structure, which has a bevel 2*f* on one end and a handle 2*b* on the other end. The cylinder-shaped structure further includes a retaining shoulder 2*d* and a tip ring collar 2*c* located close to the end connecting with the handle 2*b*. The spray tip 2 needs to be rotated 180 degrees to be cleansed. The tip ring collar 2*c* interferes with the frontend surface of the diverging tip guard members 1*c* during the rotation of the spray tip 2 to thereby limit the rotation range of the spray tip 2. As such, the step inlet hole 2*a* turns to the front of the spray tip guard to be at the outlet position. The tip ring collar 2*c* is designed to increase grip to make mounting and rotating spray tip 2 easier.

The spray tip 2 often needs to be rotated for being cleansed. The rotating torque causes wearing off the surface of the spray tip 2 and the saddle-shaped semi-cylinder surface 6*a*. The cylindrical elastic seal 6 can compensate to the sealing surface because of its elasticity even after the contacting surfaces are worn off. As such, the sealing effect is maintained and the service life of the seal is extended.

The sealing structure mainly relies on the deformation of the cylindrical elastic seal 6 to form a close fit with the surface of the spray tip 2's stepped inlet hole 2*a*. Accordingly, the required dimensional precision of the manufacturing process is greatly reduced to thereby greatly improve parts production efficiency and reduce the production cost.

Because the cylindrical elastic seal 6 has some deformation elasticity, the spray tip guard seal 1 can be hand-fastened by a user without the help of a tool (e.g., a wrench, etc.).

Additionally, and/or alternatively, a ring collar 6*b* is disposed on the cylindrical elastic seal 6 at end B. The ring collar 6*b* abuts against the end D of the metal sealing sleeve 5. End B of the cylindrical elastic seal 6 is away from where the cylindrical elastic seal 6 is inserted into the metal sealing sleeve 5. End D of the metal sealing sleeve 5 is away from the saddle-shaped semicircular surface 5*a*. The purpose of the ring collar 6*b* is to prevent the metal sealing sleeve 5 from coming off cylindrical elastic seal 6, thereby improving the assembly structural strength and stability.

The cylindrical elastic seal 6 with a circumferential positioning structure further includes an inner coupling plane 6*c* configured to be disposed between the metal sealing sleeve 5 and the cylindrical elastic seal 6. One end of the inner coupling plane 6*c* is adapted to be inserted into the metal sealing sleeve 5.

The purpose of the inner coupling plane 6*c* is to prevent the metal sealing sleeve 5 from rotating relative to the cylindrical elastic seal 6 and to avoid a gap between the saddle-shaped semi-cylinder surface 6*a* and the outer surface of the spray tip 2.

The cylindrical elastic seal 6 is nestled inside the metal sealing sleeve 5 to form the saddle seal assembly 4 by fitting the inner surface of the metal sealing sleeve 5 with the outer surface of the cylindrical elastic seal 6. The outer surface of the saddle seal assembly 4 is fitted with the inner surface of the horizontal hole 1*a* (i.e., the outer surface of the metal sealing sleeve 5 is fitted with the inner surface of the horizontal hole 1*a* and the ring collar 6*b* is fitted with the inner surface of the horizontal hole 1*a*).

The overall tight sealing structure effectively prevents dripping and splashing in actual use.

The metal sealing sleeve 5 with a circumferential positioning structure further includes at least one outer coupling plane 5*b* disposed on the inner surface of the metal sealing sleeve 5. The inner coupling plane 6*c* is fitted with the outer coupling plane 5*b* and is disposed at end A of the cylindrical elastic seal 6. End A of the cylindrical elastic seal 6 is adapted to be inserted into the metal sealing sleeve 5. The circumferential positioning structure prevents circumferential rotation and makes installation easier.

Additionally and/or alternatively, two inner fitting planes 6*c* may be symmetrically arranged and two outer fitting planes 5*b* may be symmetrically arranged. The two inner fitting planes 6*c* and the two outer fitting planes 5*b* are configured to be matched each other respectively.

Alternatively, the circumferential positioning structure may include other shapes. For example, a non-circular hole may be defined inside the metal sealing sleeve 5, and the end portion of the cylindrical elastic seal 6 configured to be inserted into the metal sealing sleeve 5 may be shaped to match/fit the non-circular hole.

Additionally, the circumferential positioning structure further includes a retaining step 7 disposed at the end of the horizontal hole 1*a* closer to the inlet, and a positioning surface 5*c* disposed at the end C of the metal sealing sleeve 5. The positioning surface 5*c* abuts against the retaining step 7. As such, the metal sealing sleeve 5 is prevented from moving too close to the spray tip 2, thereby avoiding excessive wear between the metal sealing sleeve 5 and the spray tip 2. The sealing between the metal sealing sleeve 5 and the spray tip 2 is thus maintained, and the service life of the overall structure is extended.

The design of including the positioning surface 5*c* further strengthens and avoids radial deformation of the structure of the high-pressure airless spray nozzle assembly.

The circumferential positioning structure prevents the metal sealing sleeve 5 from moving excessively close to the spray tip 2, and thus reduces the wear caused by excessive contact between the metal sealing sleeve 5 and the spray tip 2.

Figure 5:
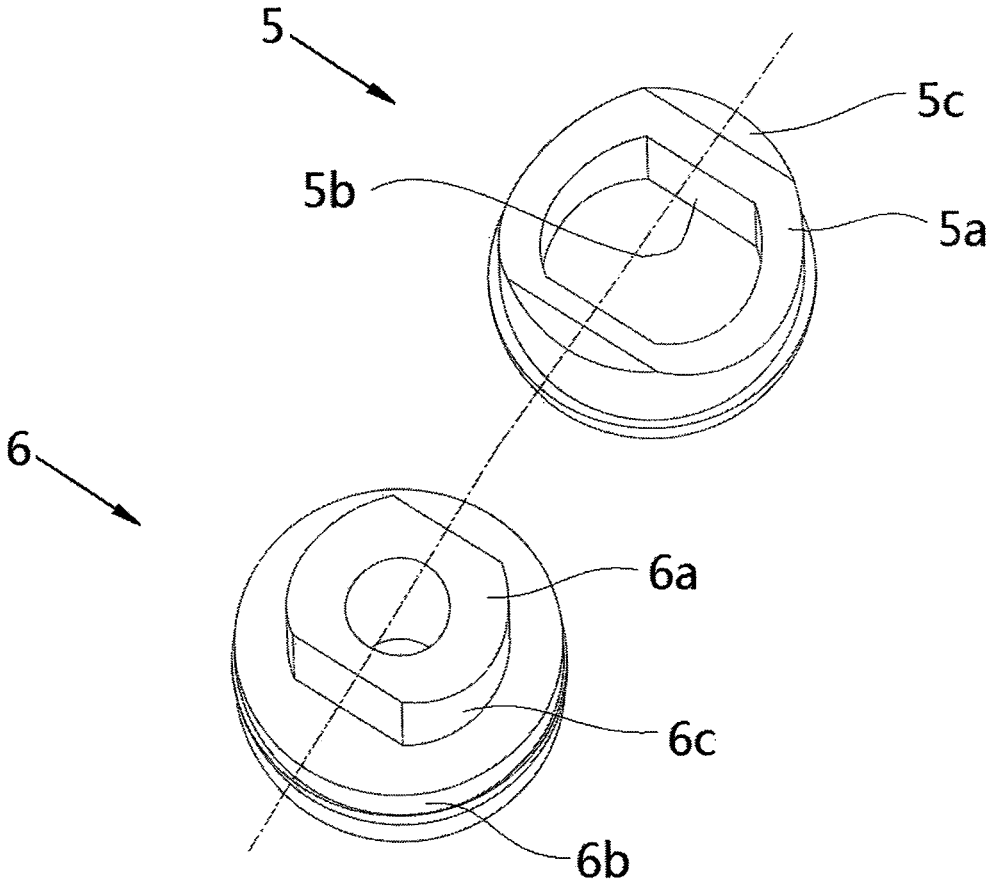
FIG. 5 is a perspective view of the saddle seal assembly of FIG. 1 when the cylindrical elastic seal is separated from the metal sealing sleeve.
Figure 6:
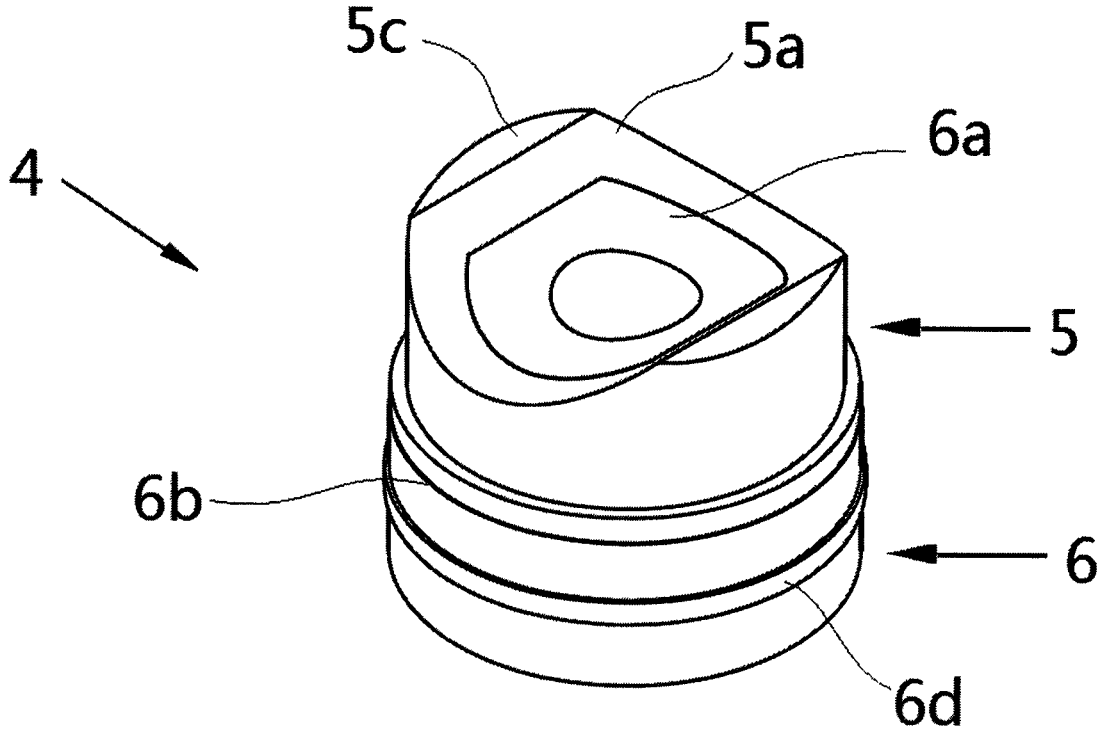
FIG. 6 is a perspective view of the saddle seal assembly of FIG. 1 when the cylindrical elastic seal is inserted into the metal sealing sleeve.

FIG. 5 shows the saddle seal assembly 4 when the cylindrical elastic seal 6 is separated from the metal sealing sleeve 5, and FIG. 6 shows the saddle seal assembly 4 when the cylindrical elastic seal 6 is inserted into the metal sealing sleeve 5.

As shown in FIG. 5, the outer diameter of the positioning surface 5*c* is smaller than or equal to the outer diameter of the ring collar 6*b*. The cylindrical elastic seal 6 further includes a groove around the ring collar 6*b*, in which an O-ring 6*d* is embedded. The O-ring 6*d* is replaceable. The sealing effect of the cylindrical elastic seal 6 maintains the sealing effect by replacing the O-ring after being worn out.

The cylindrical elastic seal 6 can be made of, for example, nylon, or rubber, or any other elastic materials etc.

The above configuration reduces the wear caused by contacts between the metal sealing sleeve 5 and the inner surface of the horizontal hole 1*a*, thereby helping the soft sealing structure of the cylindrical elastic seal 6 to be more effective.

Figure 3A:
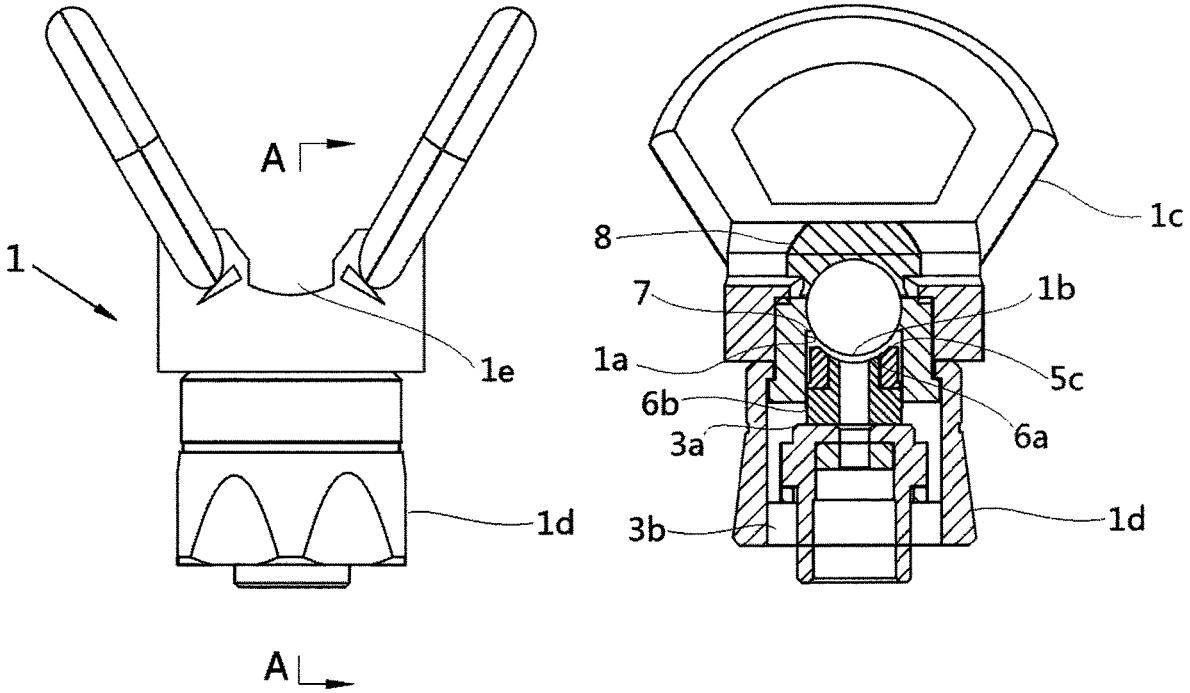
FIGS. 3A and 3B are cross-sectional views of the spray tip guard of FIG. 1 from two different cutting planes, having a spray connection gun end and a spray gun connection tube inserted into the spray tip guard.
Figure 3B:
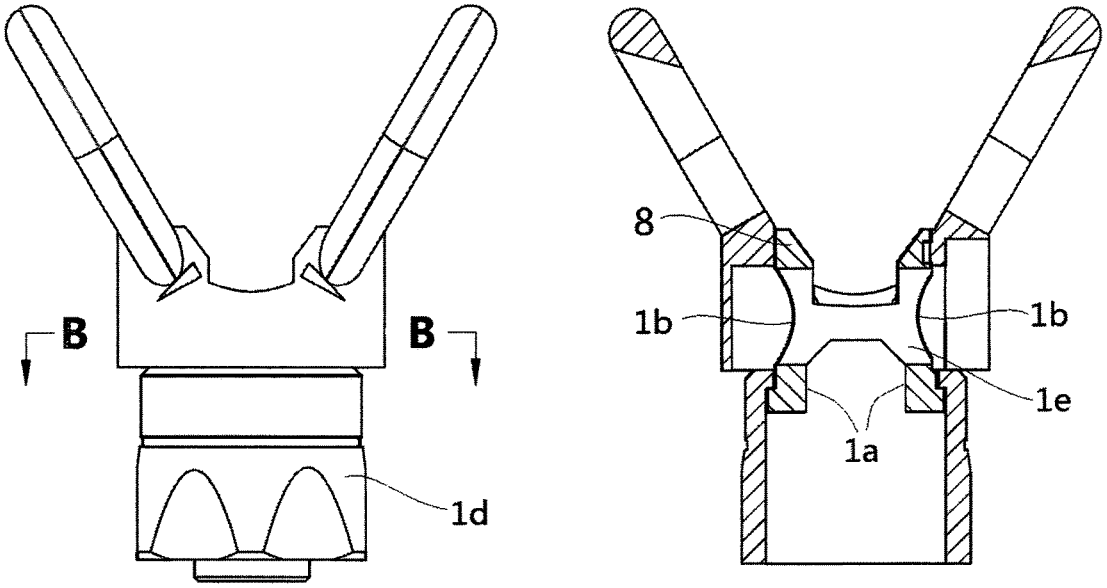

Further, FIG. 3A shows that the horizontal hole 1*a* is sleeved with a wear-resistant inner sleeve 8. FIG. 3B shows that the wear-resistant inner sleeve 8 has an open hole 1*e* matching the vertical hole 1*b* so that the spray tip 2 can be inserted into the vertical hole 1*b* through the open hole 1*e* and fitted with the inner surface of the vertical hole 1*b*. The wear-resistant inner sleeve 8 can be made of a metal material.

The wear-resistant inner sleeve 8 prevents sealing from deterioration caused by the wear between the spray tip 2 and the wear-resistant inner sleeve 8, thereby extending its service life.

FIG. 3A further shows that one end of the wear-resistant inner sleeve 8 is flush with the outlet end of the horizontal hole 1*a*, and the other end of the wear-resistant inner sleeve 8 protrudes out of the inlet end opening of the horizontal hole 1*a*. A mounting nut 1*d* is releasably mounted on the protruding end of the wear-resistant inner sleeve 8. The mounting nut can be, for example, fastened on a connection tube 3*b* with threads. The threaded connection tube 3*b* can abut against end B of the cylindrical elastic seal 6. The connection tube 3*b* squeezes the cylindrical elastic seal 6 in the axial direction so that the saddle-shaped semi-circular surface 5*a* and the saddle-shaped semi-cylinder surface 6*a* are spliced (combined) to form a saddle-shaped semi-circular surface. Since the cylindrical elastic seal 6 is squeezed by the connection tube 3*b*, the saddle-shaped semi-cylinder surface 6*a* and the spray tip 2 are in close contact to achieve a good sealing effect. The cylindrical elastic seal 6 may be made of nylon, rubber, or other elastic materials.

The production efficiency of the high-pressure airless spray nozzle assembly disclosed herein is greatly increased and the production costs of which is greatly reduced by combining a soft sealing structure and a hard sealing structure.

Because the elastic sealing design requires lower machining precision of the cylindrical elastic seal 6, the cylindrical elastic seal 6 may be injection molded in its entirety. As such, the manufacturing process has much higher production capacity and much lower processing costs than that of a mechanical machining process.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

As used herein, the phrase at least one of A, B, and C should be construed to mean a logical (A OR B OR C), using a non-exclusive logical OR, and should not be construed to mean "at least one of A, at least one of B, and at least one of C." The term subset does not necessarily require a proper subset. In other words, a first subset of a first set may be coextensive with (equal to) the first set.

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuit(s) may implement wired or wireless interfaces that connect to a local area network (LAN) or a wireless personal area network (WPAN). Examples of a LAN are Institute of Electrical and Electronics Engineers (IEEE) Standard 802.11-2016 (also known as the WIFI wireless networking standard) and IEEE Standard 802.3-2015 (also known as the ETHERNET wired networking standard). Examples of a WPAN are the BLUETOOTH wireless networking standard from the Bluetooth Special Interest Group and IEEE Standard 802.15.4.

The module may communicate with other modules using the interface circuit(s).

Although the module may be depicted in the present disclosure as logically communicating directly with other modules, in various implementations the module may actually communicate via a communications system. The communications system includes physical and/or virtual networking equipment such as hubs, switches, routers, and gateways. In some implementations, the communications system connects to or traverses a wide area network (WAN) such as the Internet. For example, the communications system may include multiple LANs connected to each other over the Internet or point-to-point leased lines using technologies including Multiprotocol Label Switching (MPLS) and virtual private networks (VPNs).

In various implementations, the functionality of the module may be distributed among multiple modules that are connected via the communications system. For example, multiple modules may implement the same functionality distributed by a load balancing system. In a further example, the functionality of the module may be split between a server (also known as remote, or cloud) module and a client (or, user) module.

Some or all hardware features of a module may be defined using a language for hardware description, such as IEEE Standard 1364-2005 (commonly called "Verilog") and IEEE Standard 1076-2008 (commonly called "VHDL"). The hardware description language may be used to manufacture and/or program a hardware circuit. In some implementations, some or all features of a module may be defined by a language, such as IEEE 1666-2005 (commonly called "SystemC"), that encompasses both code, as described below, and hardware description.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTMLS (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A saddle seal assembly for a high-pressure airless spray nozzle having a spray tip, comprising:

a metal sealing sleeve including a flat inner coupling plane, a first saddle-shaped semi-cylinder surface, and a positioning surface disposed at an end of the metal sealing sleeve, the positioning surface being adjacent to the first saddle-shaped semi-cylinder surface, the flat inner coupling plane being adjacent to the first saddle-shaped semi-cylinder surface, the first saddle-shaped semi-cylinder matching with an outer surface of the spray tip to form an outer hard sealing structure; and a cylindrical elastic seal including a flat end portion and a second saddle-shaped semi-cylinder surface, the flat end portion being adjacent to the second saddle-shaped semi-cylinder surface, the second saddle-shaped semi-cylinder surface matching with the outer surface of the spray tip to form an inner flexible sealing structure, wherein the cylindrical elastic seal is configured to be releasably inserted into the metal sealing sleeve with the flat end portion of the cylindrical elastic seal and extended beyond the first saddle-shaped semi-cylinder surface, wherein the flat end portion of the cylindrical elastic seal is adapted to fit with the flat inner coupling plane of the metal sealing sleeve to prevent circumferential rotation, and wherein the first saddle-shaped semi-cylinder surface and the second saddle-shaped semi-cylinder surface are configured to be spliced to form a continuous saddle-shaped semi-cylinder surface with the first saddle-shaped semi-cylinder surface serving as a preliminary seal and the second saddle-shaped semi-cylinder surface serving as a complemental seal, to thereby seal a stepped inlet hole of the high-pressure airless spray nozzle.

2. The saddle seal assembly of claim 1, further comprising a ring collar disposed on a second end portion of the cylindrical elastic seal, wherein the ring collar abuts against a first end portion of the metal sealing sleeve, to thereby prevent the metal sealing sleeve from coming off the cylindrical elastic seal.

3. The saddle seal assembly of claim 2, wherein the metal sealing sleeve is fitted with the outer surface of the cylindrical elastic seal to form the saddle seal assembly.

4. The saddle seal assembly of claim 2, wherein:

the flat inner coupling plane of the metal sealing sleeve is configured to be disposed at the flat end portion of the cylindrical elastic seal to prevent circumferential rotation, the metal sealing sleeve further comprises at least one outer coupling plane disposed on the inner surface of the metal sealing sleeve, and the inner coupling plane is configured to be fitted with the at least one outer coupling plane and is disposed at the first end portion of the cylindrical elastic seal to thereby prevent the metal sealing sleeve from rotating relative to the cylindrical elastic seal and to avoid a gap between the saddle-shaped semi-cylinder surface.

5. The saddle seal assembly of claim 2, wherein the metal sealing sleeve further comprises:

the positioning surface disposed at the second end portion of the metal sealing sleeve and configured to abut against a retaining step disposed within the high-pressure airless spray nozzle to thereby prevent the metal sealing sleeve from moving toward the spray tip.

6. The saddle seal assembly of claim 5, wherein the outer diameter of the positioning surface is smaller than or equal to the outer diameter of the ring collar.

7. The saddle seal assembly of claim 2, wherein the cylindrical elastic seal further comprises a groove around the ring collar, and an O-ring embedded within the groove.

8. The saddle seal assembly of claim 1, wherein the cylindrical elastic seal is made of an elastic material.

9. The saddle seal assembly of claim 8, wherein the elastic material is nylon or rubber.

10. A high-pressure airless spray nozzle, comprising:

a spray tip guard;

a spray tip configured to be inserted into the spray tip guard perpendicularly to the axis of the spray tip guard; and a saddle seal assembly configured to be inserted into the spray tip guard along the axis of the spray tip guard, wherein the saddle seal assembly includes:

a metal sealing sleeve including a flat inner coupling plane, a first saddle-shaped semi-cylinder surface, and a positioning surface disposed at an end of the metal sealing sleeve, the positioning surface being adjacent to the first saddle-shaped semi-cylinder surface, the flat inner coupling plane being adjacent to the first saddle-shaped semi-cylinder surface, the first saddle-shaped semi-cylinder matching with an outer surface of the spray tip to form an outer hard sealing structure; and a cylindrical elastic seal including a flat end portion and a second saddle-shaped semi-cylinder surface, the flat end portion being adjacent to the second saddle-shaped semi-cylinder surface, the second saddle-shaped semi-cylinder matching with the outer surface of the spray tip to form an inner flexible sealing structure, wherein the cylindrical elastic seal is configured to be releasably inserted into the metal sealing sleeve with the flat end portion of the cylindrical elastic seal and extended beyond the first saddle-shaped semi-cylinder surface, wherein the flat end portion of the cylindrical elastic seal is adapted to fit with the flat inner coupling plane of the metal sealing sleeve to prevent circumferential rotation, and wherein the first saddle-shaped semi-cylinder surface and the second saddle-shaped semi-cylinder surface are configured to be spliced to form a continuous saddle-shaped semi-cylinder surface with the first saddle-shaped semi-cylinder surface serving as a preliminary seal and the second saddle-shaped semi-cylinder surface serving as a complemental seal, to thereby seal a stepped inlet hole of the high-pressure airless spray nozzle.

11. The high-pressure airless spray nozzle of claim 10, wherein the saddle seal assembly further comprising a ring collar disposed on a second end portion of the cylindrical elastic seal, wherein the ring collar abuts against a first end portion of the metal sealing sleeve, to thereby prevent the metal sealing sleeve from coming off the cylindrical elastic seal.

12. The high-pressure airless spray nozzle of claim 11, wherein the metal sealing sleeve is fitted with the outer surface of the cylindrical elastic seal to form the saddle seal assembly.

13. The high-pressure airless spray nozzle of claim 11, wherein:

the cylindrical elastic seal further comprises a flat inner coupling plane of the metal sealing sleeve is configured to be disposed at the flat end portion of the cylindrical elastic seal to prevent circumferential rotation, the metal sealing sleeve further comprises at least one outer coupling plane disposed on the inner surface of the metal sealing sleeve, and the inner coupling plane is configured to be fitted with the at least one outer coupling plane and is disposed at the first end portion of the cylindrical elastic seal to thereby prevent the metal sealing sleeve from rotating relative to the cylindrical elastic seal and to avoid a gap between the saddle-shaped semi-cylinder surface.

14. The high-pressure airless spray nozzle of claim 11, wherein the metal sealing sleeve further comprises:

the positioning surface disposed at the second end portion of the metal sealing sleeve and configured to abut against a retaining step disposed within the high-pressure airless spray nozzle to thereby prevent the metal sealing sleeve from moving toward the spray tip.

15. The high-pressure airless spray nozzle of claim 14, wherein the outer diameter of the positioning surface is smaller than or equal to the outer diameter of the ring collar.

16. The high-pressure airless spray nozzle of claim 11, wherein the cylindrical elastic seal further comprises a groove around the ring collar, and an O-ring embedded within the groove.

17. The high-pressure airless spray nozzle of claim 10, wherein the cylindrical elastic seal is made of an elastic material.

18. The high-pressure airless spray nozzle of claim 17, wherein the elastic material is nylon or rubber.

19. The high-pressure airless spray nozzle of claim 10, wherein the spray tip guard further comprises a mounting nut and a wear-resistant inner sleeve, and the spray tip is adapted to be inserted into a connection hole defined within the wear-resistant inner sleeve.

20. The high-pressure airless spray nozzle of claim 19, wherein the wear-resistant inner sleeve is made of a metal material.

* * * * *